US010866027B2

(12) United States Patent
Bucko

(10) Patent No.: US 10,866,027 B2
(45) Date of Patent: Dec. 15, 2020

(54) DEVICE TO EXTRACT DRY CLOTHES FROM A CLOTHES DRYER

(71) Applicant: Paul Bucko, Cape May Court House, NJ (US)

(72) Inventor: Paul Bucko, Cape May Court House, NJ (US)

( * ) Notice: Subject to any disclaimer, the term of this patent is extended or adjusted under 35 U.S.C. 154(b) by 0 days.

(21) Appl. No.: 16/258,761

(22) Filed: Jan. 28, 2019

(65) Prior Publication Data

US 2020/0240707 A1 Jul. 30, 2020

(51) Int. Cl.
*F26B 11/02* (2006.01)
*E04H 15/00* (2006.01)

(52) U.S. Cl.
CPC ..... *F26B 11/02* (2013.01); *E04H 15/00* (2013.01)

(58) Field of Classification Search
CPC .... F26B 3/00; F26B 3/02; F26B 11/00; F26B 11/02; F26B 19/00; F26B 21/00; F26B 21/06; E04H 15/00
USPC ..... 34/595–610
See application file for complete search history.

(56) References Cited

U.S. PATENT DOCUMENTS 1,284,579 A * 11/1918 Brown ..... B65D 7/20 220/485
2,338,776 A * 1/1944 Miller ..... D06F 73/00 223/67
2,685,441 A * 8/1954 Baade ..... D06F 95/002 177/126
2,904,897 A * 9/1959 Whyte ..... D06F 95/004 34/90
3,739,492 A * 6/1973 Brooks ..... D06F 58/14 34/622
4,091,548 A * 5/1978 Daily ..... D06F 58/04 312/311
5,276,979 A * 1/1994 Gordon, Sr. ..... D06F 58/04 34/109
5,361,516 A * 11/1994 Dahman ..... D06F 59/02 223/73
5,519,949 A * 5/1996 Gibson, Jr. ..... D06F 58/04 34/109
5,555,648 A * 9/1996 Griffin ..... D06F 59/02 223/67
6,026,592 A * 2/2000 Herr ..... D06F 58/04 34/446
6,041,517 A * 3/2000 Wang ..... D06F 59/02 34/439
6,052,916 A * 4/2000 Tasoniero ..... D06F 73/00 34/103

(Continued)

OTHER PUBLICATIONS

Michelle Manetti, Great Laundry Tip Shows You How to Unload a Clothes Dryer, Feb. 8, 2013.

*Primary Examiner* — Stephen M Gravini
(74) *Attorney, Agent, or Firm* — Norman E. Lehrer

(57) ABSTRACT

Disclosed is a device to extract dry clothes from a clothes dryer. The device comprises a support loop. The support loop includes a netting disposed within the support loop. The support loop is made of at least one of a plurality of fiberglass rods and stainless steel spring. The support loop flexes to allow it to fit into an opening at a front door of the clothes dryer and then expands to overlie the clothes. The drum is then manually rotated 180 degrees so that the clothes lie on top of the netting and the entire device is then again flexed and removed from the dryer with the dried clothes.

1 Claim, 3 Drawing Sheets

(56) References Cited

U.S. PATENT DOCUMENTS

| | | | | |
|---|---|---|---|---|
| 6,115,936 | A * | 9/2000 | Arlie | D06F 58/04 34/106 |
| 6,250,400 | B1 * | 6/2001 | Bucko | B25H 3/006 173/171 |
| 6,780,101 | B2 * | 8/2004 | Buhler | D06F 58/14 34/390 |
| 7,083,072 | B2 * | 8/2006 | Redlin | D06F 59/02 223/67 |
| 7,228,646 | B1 * | 6/2007 | Purcell | D06F 58/04 34/104 |
| 8,667,707 | B2 * | 3/2014 | Date | D06F 58/203 34/565 |
| 9,127,885 | B2 * | 9/2015 | Provenzano | F26B 25/08 |
| 9,850,622 | B1 * | 12/2017 | Lavernia | D06F 95/002 |
| 10,041,205 | B2 * | 8/2018 | McLoughlin | D06F 59/02 |

* cited by examiner

DEVICE TO EXTRACT DRY CLOTHES FROM A CLOTHES DRYER

TECHNICAL FIELD

The present invention is generally related to a clothes extractor. More particularly, the present invention relates to a device to extract dry clothes from a clothes dryer.

BACKGROUND OF THE INVENTION

Typically, extracting dried clothes from a clothes dryer is a tedious and tiring task for a user, especially if the user is suffering from back pain. Generally, after drying, the clothes do not stick together inside the clothes dryer, so the dried clothes must be removed from the dryer one-by-one. Further, the user has to remove the dried clothes one-by-one to shake and smooth the dried clothes to minimize wrinkling. Since the front door of the clothes dryer is positioned at a low level, the user has to bend over each time he or she reaches into the clothes dryer to retrieve the dried clothes. This repetitive process of extracting the dried clothes is very hard on the user's back. Additionally, using a clothes dryer involves several other tasks that require bending over or squatting down to reach into the clothes dryer.

Therefore, the existing methods and device for extracting clothes from the clothes dryer are not quite satisfactory, and it has much room for improvement. It would be desirable to improve the extracting method and provide a device to extract the dried clothes from the clothes dryer to improve efficiency.

Thus, in view of the above, there is a long-felt need in the industry to address the aforementioned deficiencies and inadequacies.

Further limitations and disadvantages of conventional and traditional approaches will become apparent to one of ordinary skill in the art through comparison of described systems with some aspects of the present disclosure, as set forth in the remainder of the present application and with reference to the drawings.

SUMMARY OF THE INVENTION

A device to extract dry clothes from a clothes dryer is provided, substantially, as shown in and/or described in connection with at least one of the figures, as set forth more completely in the claims.

The device comprises a support loop. The support loop includes a netting or fabric disposed within the perimeter of the support loop. The support loop flexes to allow it to fit into the opening at the front door of the clothes dryer and then expands to lie over the clothes. The drum of the dryer is then manually rotated 180 degrees so that the clothes lie on top of the netting of the support loop. The support loop with the clothes thereon is then removed from the dryer.

In a preferred embodiment, the support loop is made of at least one of a plurality of fiberglass rods and stainless steel spring rods.

One advantage of the present invention is that it facilitates the user to extract the dried clothes from the clothes dryer effectively.

Another advantage of the present invention is that it provides a cost-effective, simple and durable construction that is easy to clean and maintain.

These features and advantages of the present disclosure may be appreciated by reviewing the following description of the present disclosure, along with the accompanying figures wherein like reference numerals refer to like parts.

BRIEF DESCRIPTION OF THE DRAWINGS

The accompanying drawings illustrate embodiments of systems, methods, and other aspects of the disclosure. Any person of ordinary skill in the art will appreciate that the illustrated element boundaries (e.g., boxes, groups of boxes, or other shapes) in the figures represent an example of the boundaries. In some examples, one element may be designed as multiple elements, or multiple elements may be designed as one element. In some examples, an element shown as an internal component of one element may be implemented as an external component in another and vice versa. Furthermore, the elements may not be drawn to scale.

Various embodiments will hereinafter be described in accordance with the appended drawings, which are provided to illustrate, not limit, the scope, wherein similar designations denote similar elements, and in which.

DETAILED DESCRIPTION OF THE PREFERRED EMBODIMENT

Figure 1:
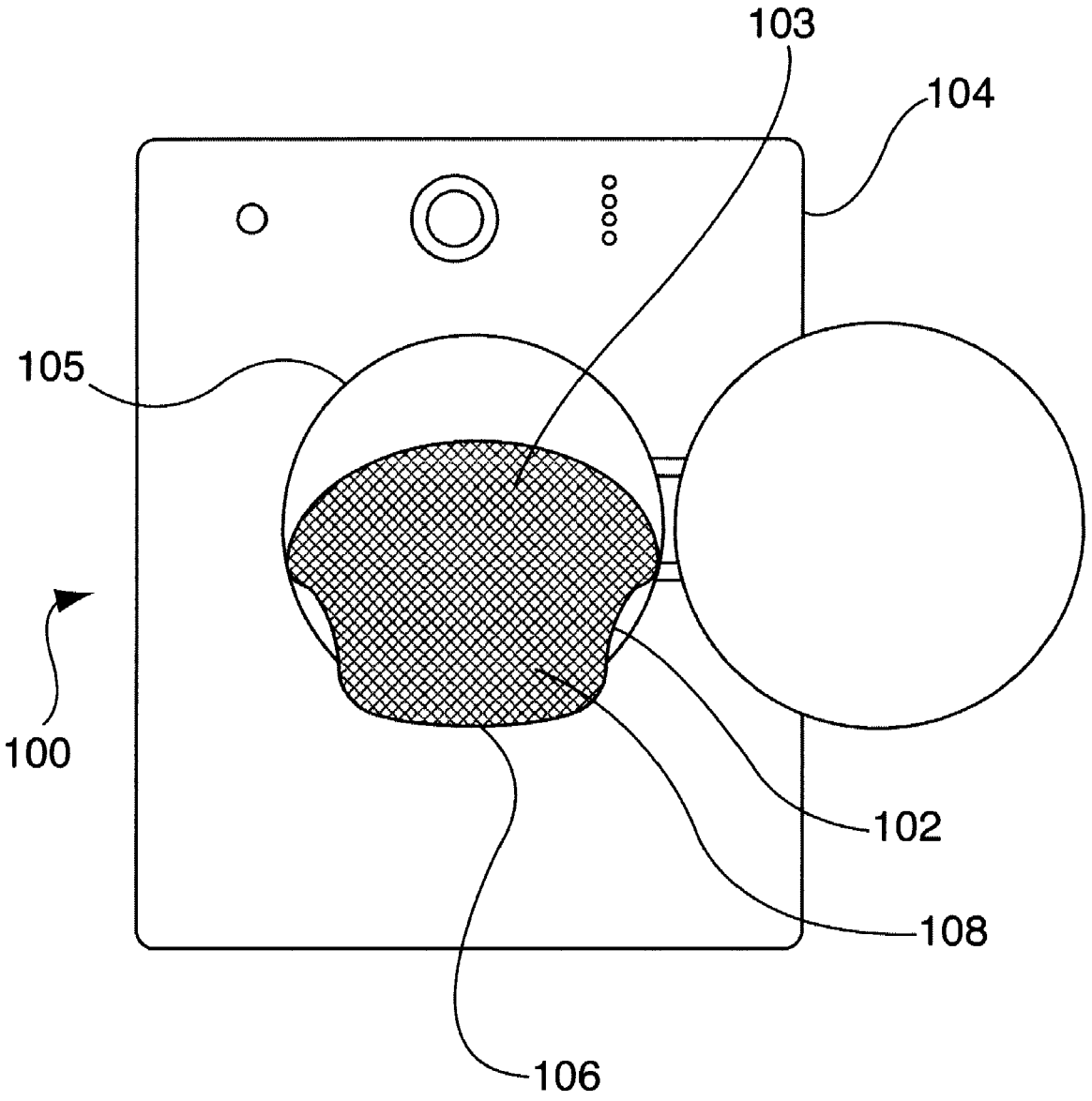
FIG. 1 illustrates an operational diagram of the present device comprising a support loop that flexes that allows the same to fit into an opening at a front door of the clothes dryer, in accordance with at least one embodiment.

The present disclosure is best understood with reference to the detailed figures and description set forth herein. Various embodiments have been discussed with reference to the figures. However, those skilled in the art will readily appreciate that the detailed descriptions provided herein with respect to the figures are merely for explanatory purposes, as the methods and systems may extend beyond the described embodiments. For instance, the teachings presented and the needs of a particular application may yield multiple alternative and suitable approaches to implement the functionality of any detail described herein. Therefore, any approach may extend beyond certain implementation choices in the following embodiments.

Methods of the present invention may be implemented by performing or completing manually, automatically, or a combination thereof, selected steps or tasks. The term "method" refers to manners, means, techniques and procedures for accomplishing a given task including, but not limited to, those manners, means, techniques, and procedures either known to, or readily developed from known manners, means, techniques and procedures by practitioners of the art to which the invention belongs. The descriptions, examples, methods, and materials presented in the claims and the specification are not to be construed as limiting but rather as illustrative only. Those skilled in the art will envision many other possible variations within the scope of the technology described herein.

The present device 102 is used to extract dry clothes 110 from a clothes dryer 104 having an opening 105 at the front thereof. The device 102 is comprised essentially of two parts: a support loop 106 and netting or fabric 108 within the center of the loop 106. Preferably, the entire device 102 (or at least the support loop) lies in a single plane. The forward end 103 of the device 102 is wider than the opening 105 at the front of the dryer 104. Accordingly, in order to insert the device 102 into the opening 105 so as to be positioned over the dry clothes 110, it is capable of flexing sufficiently so as to fit through the opening 105. The support loop 106 then expands to overlie the clothes. The present device 102 is, of course, heat-resistant to the extent necessary for the temperatures inside the clothes dryer.

After the device 102 is inserted into the dryer 104 and is placed over the clothes 110, the drum of the dryer is manually turned 180 degrees. This rotates the clothes 110 and the device 102 until the clothes fall onto the netting 108. At this point, the device 102 is withdrawn from the dryer 104 with the clothes 110 resting thereon. It should be noted that because of the shape of the loop 106 and particularly the angles formed by the loop sections 112*d* and 112*e*, as the device 102 is being withdrawn from the dryer 104, the opening 105 forces the loop 106 to begin to fold or flex around the clothing 110 so that the device 102 will fit through the opening 105.

Figure 2:
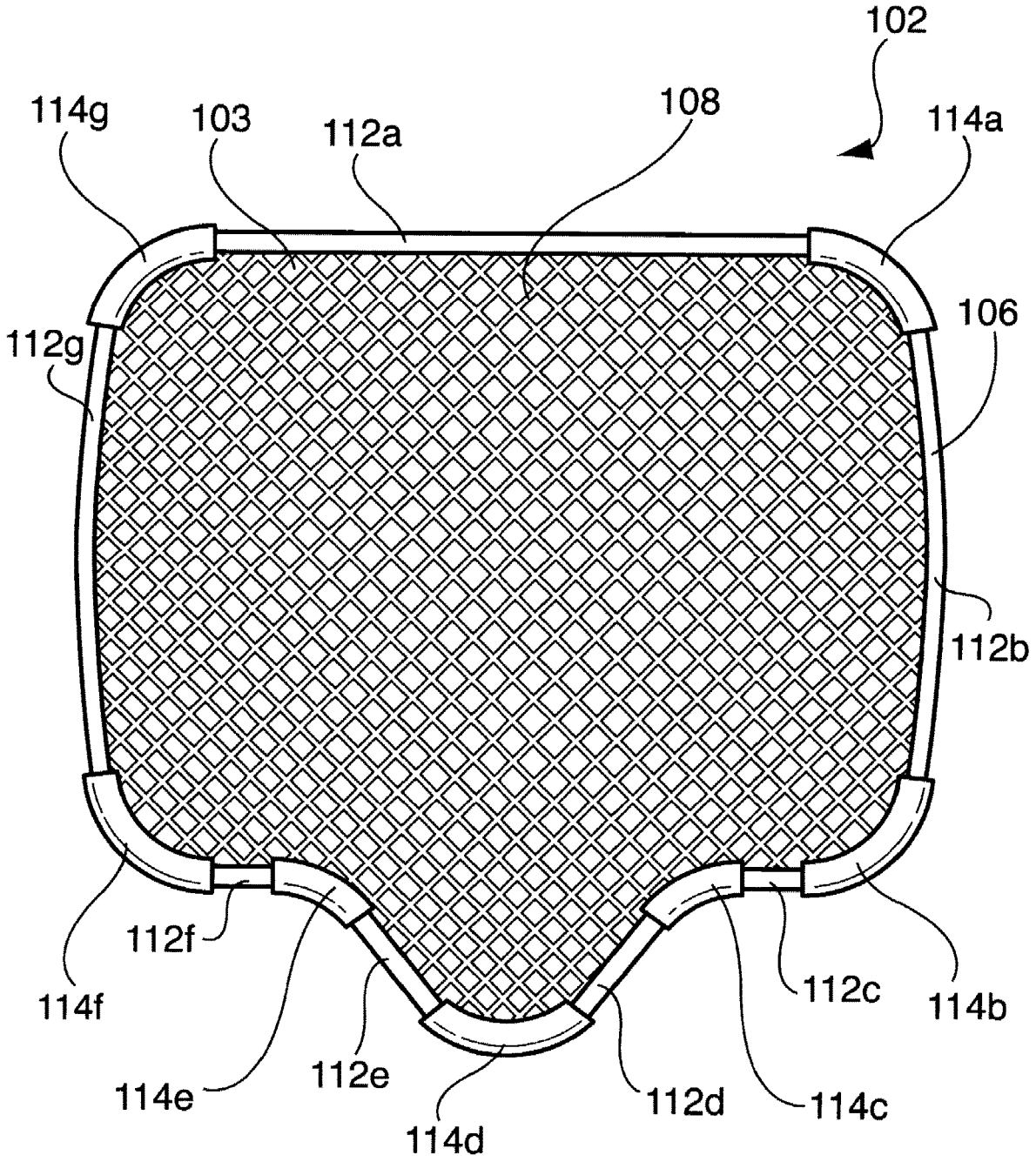
FIG. 2 illustrates an exemplary diagram of the fiberglass rods and netting that make up the loop and fabric of the extractor in accordance with at least one embodiment.
Figure 3:
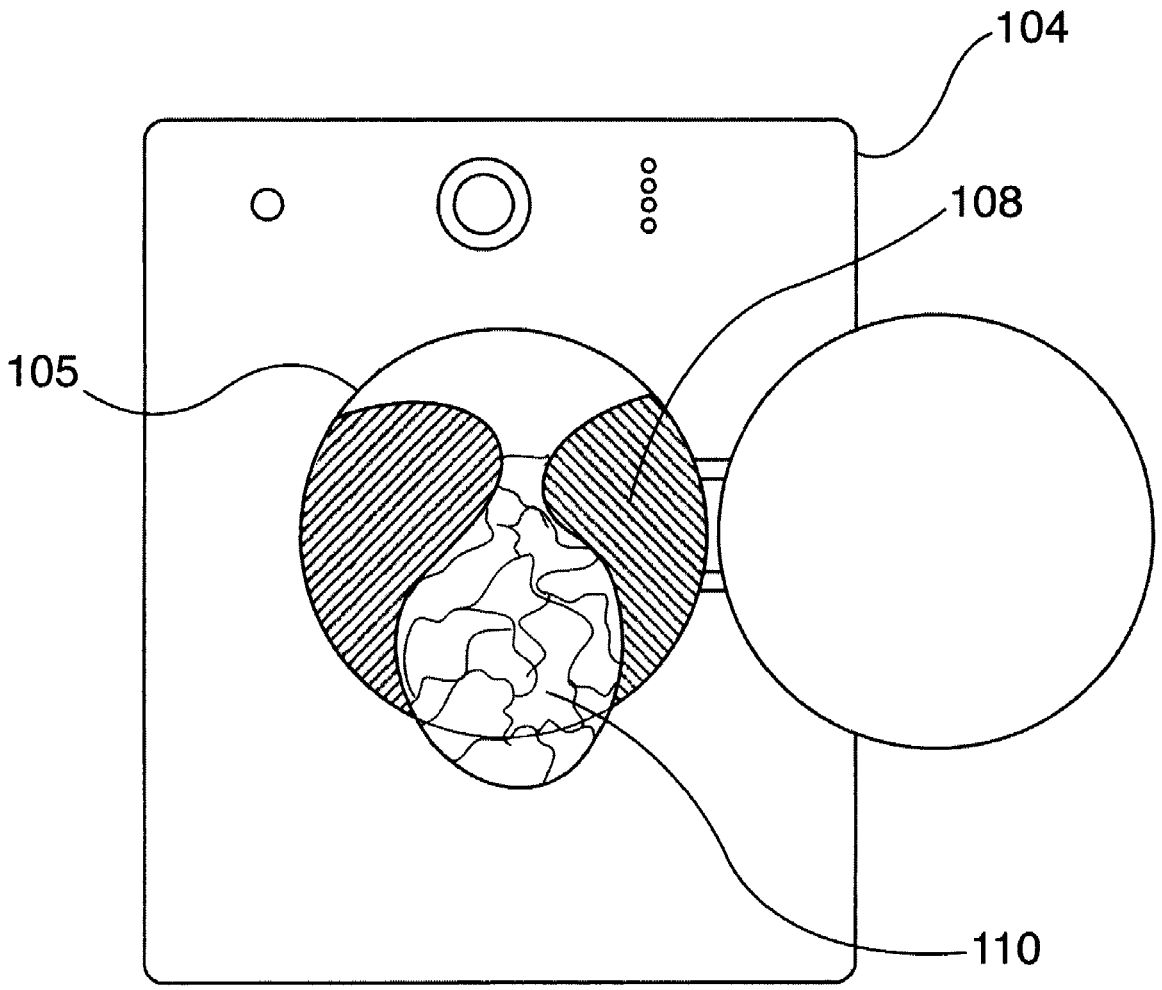
FIG. 3 illustrates an operational diagram of the manual rotation of a dryer drum to 180 degrees to extract the dry clothes from the clothes dryer, in accordance with at least one embodiment.

FIG. 2 illustrates an exemplary diagram of the device 102. The support loop 106 is preferably made of a plurality of somewhat self-supporting but flexible fiberglass rods 112*a*-112*g* with their ends connected together with a plurality of tubular coupling members 114*a*-114*g*. The fabric or netting 108 is then attached to the loop 106. This can be done in any known manner such as by having a sleeve formed around the periphery of the netting 108 into which can be inserted the rods 112*a*-112*g* and, if desired, also the coupling members 114*a*-114*g*. It should also be noted that other materials such as spring steel or bamboo or other materials can be used in lieu of the fiberglass rods.

Although the loop 106 is shown to be made up of numerous sections joined together, it is not beyond the scope of the invention to make the same from fewer sections or even, possibly, form a single piece of spring steel or fiberglass that is molded into the desired shape.

Thus the present device removes the dry clothes from a clothes dryer. The present device is a loop made of fiberglass rods or stainless steel spring that has fabric or netting within the loop. After clothes are dried, the front door of the clothes dryer is opened, and the present device is placed over the top of the dry clothes. The device flexes to allow it to fit into the door and then expands to overlie the clothes. The user then manually rotates the drum of the dryer 180 degrees so that the clothes lie on top of the fabric or netting of the device. The device with the dry clothes on it is then removed from the clothes dryer. The device fits through the front opening of the clothes dryer by being flexed as it is pulled through.

It will be apparent to those skilled in the art that various modifications and variations can be made to the present invention without departing from the spirit and scope of the invention. There is no intention to limit the invention to the specific form or forms enclosed. On the contrary, the intention is to cover all modifications, alternative constructions, and equivalents falling within the spirit and scope of the invention, as defined in the appended claims. Thus, it is intended that the present invention cover the modifications and variations of this invention, provided they are within the scope of the appended claims and their equivalents. In this regard, no language in the specification should be construed as indicating any non-claimed element as essential to the practice of the invention.

I claim:

1. A method of extracting dried clothes from a clothes dryer having a door including the steps of:

providing a removal device comprised of a loop having a center, said loop being comprised of at least one self-sustaining but flexible rod having netting attached thereto that covers the center of said loop;

flexing said device and inserting the device into the door of said clothes dryer;

placing said device over said dried clothes in said clothes dryer and allowing said device to expand to the device's natural form;

manually rotating the drum of said dryer 180 degrees along with the device and allowing said clothes to fall onto and lie on said netting of said device, and removing said device from said clothes dryer with said dried clothes resting thereon.

* * * * *